US005518239A

United States Patent [19]

Johnston

[11] Patent Number: 5,518,239

[45] Date of Patent: May 21, 1996

[54] LOTTERY RACING SWEEPSTAKE

[76] Inventor: William H. Johnston, 8901 County Line, Hinsdale, Ill. 60521

[21] Appl. No.: 271,763

[22] Filed: Jul. 7, 1994

[51] Int. Cl.[6] ..... A63F 3/06

[52] U.S. Cl. ..... 273/139; 273/269

[58] Field of Search ..... 273/138 R, 138 A, 273/139, 86 B, 269; 283/903

[56] References Cited

U.S. PATENT DOCUMENTS

| | | | |
|---|---|---|---|
| 4,288,077 | 9/1981 | Rose et al. | 273/246 |
| 4,429,877 | 2/1984 | Coppock | 273/139 |
| 4,540,174 | 9/1985 | Coppock | 273/138 R |
| 4,883,636 | 11/1989 | Fantle, Jr. | 273/269 |
| 4,962,950 | 10/1990 | Champion | 283/67 |
| 5,108,115 | 4/1992 | Berman et al. | 273/439 |
| 5,129,652 | 7/1992 | Wilkinson | 273/139 |
| 5,265,880 | 11/1993 | Maksymec | 273/269 |
| 5,332,218 | 7/1994 | Lucey | 273/138 A |

FOREIGN PATENT DOCUMENTS

| | | | |
|---|---|---|---|
| 2229565 | 9/1990 | United Kingdom | 273/138 A |

OTHER PUBLICATIONS

"Sportsman's Park Bingo Sweepstakes–Gas City" game ticket, 1982.

"Sportsman's Sweepstakes" game ticket, 1968.

"Bingo–Michigan Lottery" promotional material, Apr., 1994.

*Primary Examiner*—Jessica J. Harrison

*Attorney, Agent, or Firm*—Marshall, O'Toole, Gerstein, Murray & Borun

[57] ABSTRACT

A method of playing a lottery game is disclosed in which winning numbers are selected by the outcome of one or more sporting events such as horse races. A lottery ticket may be printed which has three rows and three columns of randomly generated numbers. The winning numbers, as determined by the sporting event, are also placed in a three-by-three grid and compared to each player's grid of random numbers. A pattern is formed by comparing the winning numbers to the player's numbers and payment is made to each player in accordance with the number of complete rows, columns and diagonals in each player's pattern.

20 Claims, 2 Drawing Sheets

LOTTERY RACING SWEEPSTAKE

BACKGROUND OF THE INVENTION

1. Field of Invention

The present invention relates generally to a method of running a lottery and more particularly to a method of running a lottery where the winning numbers are selected in accordance with the outcome of a sporting event.

2. Background Art

Conventional lotteries operated by governmental entities or casinos generally assign a number or set of numbers to an individual for a fixed fee. The numbers may be assigned randomly or the players may have the ability to choose numbers or sets of numbers which are then printed on a lottery ticket. Once ticket sales have ended, winning numbers are selected randomly, either by computer or a mechanical device such as a hopper filled with numbered ping-pong balls. The balls are mixed and pulled at random from the hopper to select the winning numbers.

While lotteries have been very successful, over the last decade the public's interest has begun to decrease. Many states have turned to televising number-selection shows in an effort to generate additional interest in the lottery. The number selection shows, however, possess little excitement or suspense since viewing ping-pong balls falling from a hopper has relatively little spectator appeal. There, therefore, exists a need for a method of selecting winning lottery numbers that will generate spectator interest and thereby increase sales of lottery tickets.

SUMMARY OF THE INVENTION

In accordance with the one aspect of present invention, a method of playing a lottery game includes the steps of generating random numbers and assigning the random numbers to a player. A sporting event is selected having a set of possible outcomes and outcome numbers are assigned to the possible outcomes of the sporting event. The sporting event is observed and a set of winning numbers is determined from the outcome numbers based on the outcome of the sporting event. The set of winning numbers is compared to the random numbers assigned to the player and the player is paid a sum based on the similarity of the group of random numbers to the set of winning numbers.

In accordance with another aspect of the present invention, the sporting event may be a race having a plurality of entrants and the winning numbers are determined in accordance with the places in which the entrants finish the race. The sporting event may be a plurality of races with a plurality of entrants in each race and the winning numbers may be determined in accordance with the places in which the entrants in each race finish those races.

The sporting event may have three races where each race has a first place, second place and third place finisher. The group of random numbers may be placed into a first grid having a first row, a second row, a third row, a first column, a second column and a third column. The winning numbers may be determined by the first place, second place and third place finishers in each of the three races and may be placed in a second grid having a first row, a second row, a third row, a first column, a second column and a third column. The player may be paid in accordance with a pattern formed by the numbers in the first grid which match the numbers in corresponding rows and columns of the second grid.

The player may be paid in accordance with the number of complete rows and complete columns in the pattern. The pattern may also have diagonals and the player may be paid in accordance with the number of complete rows, columns and diagonals in the pattern. The first grid may have a free space.

The winning numbers in the first row of the second grid may be determined by the first place, second place and third place finishers in the first race, the winning numbers in the second row of the second grid may be determined by the first place, second place and third place finishers of the second race and the winning numbers of the third row of the second grid may be determined by the first place, second place and third place finishers of the second race. The random numbers may be printed on a card and the card may have two groups of random numbers and each group is printed in a grid having three rows and three columns. The card may also have four groups of random numbers.

There may be a plurality of players and each player has a different assigned group of random numbers than any other player's assigned group of random numbers.

BRIEF DESCRIPTION OF THE DRAWINGS

Other features and advantages of the invention will be apparent from the following description taken in connection with the drawings wherein.

DETAILED DESCRIPTION

Figure 1:
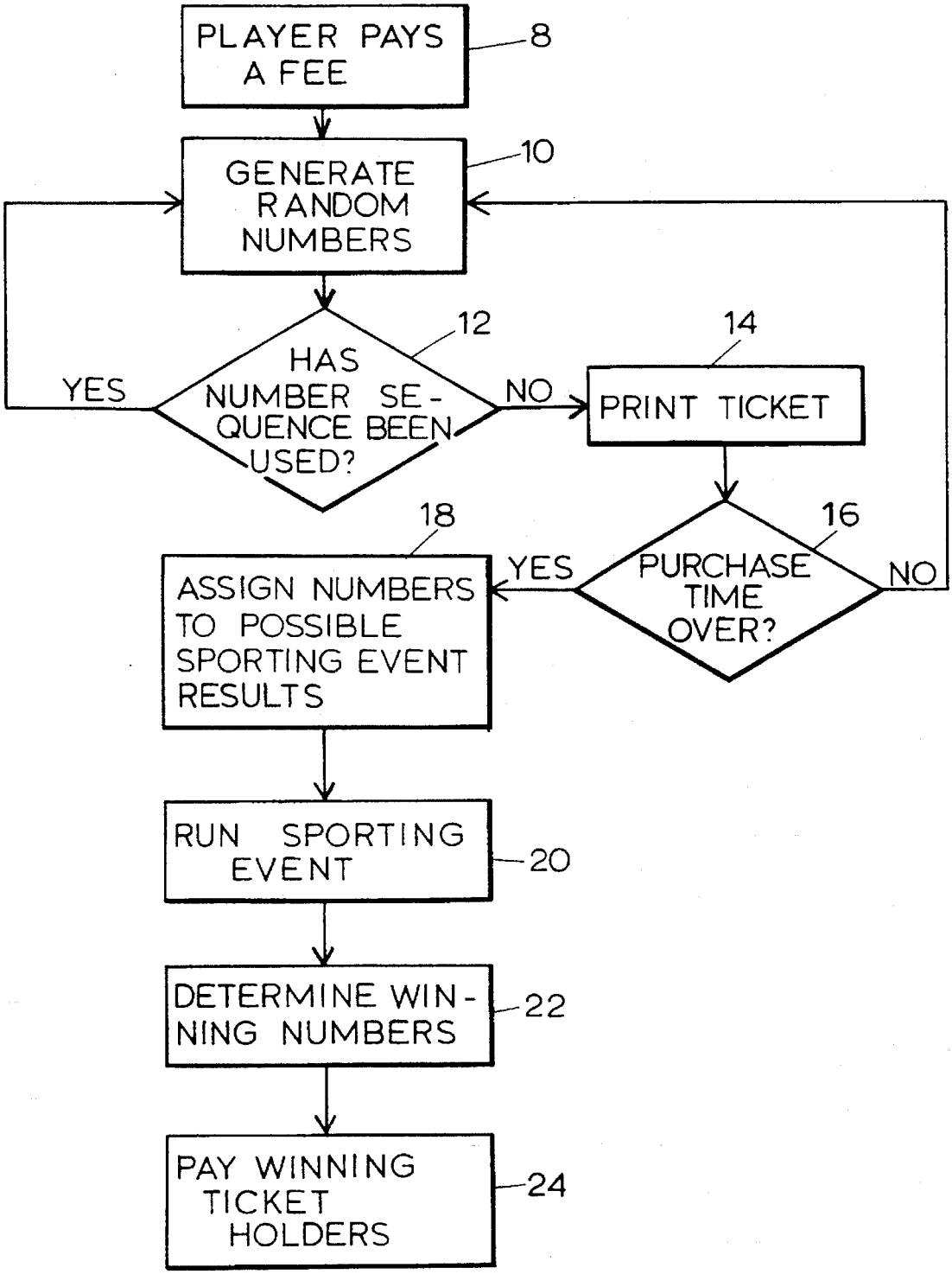
FIG. 1 is a flow-chart of the method of running a lottery of the present invention.

Referring initially to FIG. 1 a method of playing a lottery game of the present invention is illustrated. In block 8 a player pays a fee in order to purchase a chance at winning the lottery. The fee may be paid to an individual running a lottery machine or to an automated machine. At block 10 a set of random numbers is generated by a suitable device such as a computer of the type currently used to generate random numbers for a lottery. A variety of formats of random numbers may be used, including one multi-digit number, a series of multi-digit numbers or a series of single-digit numbers. The exact format of the random numbers generated will depend on the overall design of the lottery and is more fully discussed below.

Control then passes to block 12 to determine whether the random number or random number sequence has already been used. In most lottery configurations of the present invention, it will be desirable that any lottery player have a number or sequence of numbers different from those of any other player so that there are not duplicate or multiple winners of the same prize. However, if there are enough players or entrants in the lottery or the particular lottery design permits, it may be possible to allow more than one player to have the same number or sequence of numbers. If a number or sequence has already been used, control passes back to block 10 to generate a new set of random numbers. As an alternative to generating random numbers and subsequently determining whether they have been used, it may be possible to set up a random number generator which is only capable of selecting numbers or sequences of numbers which have not been used, so that determining whether numbers have been used in block 12 is not necessary.

If the number sequence has not been used, control passes to block 14 where a lottery ticket is printed. The purpose of printing the lottery ticket is to assign the group or sequence of random numbers to a player, i.e., the individual holding the ticket. Other mechanisms of assigning the group of random numbers to a player are possible, including electronic transmission. Whatever method of assigning the numbers is used, it is important that the player know the numbers prior to the running of the sporting event, as will be more fully discussed below.

Once the ticket has been printed, control passes to block 16 to determine whether the purchase time is over. At some time, generally shortly before the running of the sporting event discussed below, sales of tickets will be terminated. If the purchase time is not over, control passes back to block 10 so that additional random numbers can be generated in order to supply tickets to other players.

If the purchase time is over, control passes to block 18 in order to assign outcome numbers to possible sporting event results. This step necessarily involves choosing a sporting event, which is preferably a race or group of races. However, other sporting events can also be used with the present invention, including team sports such as football, baseball, hockey, basketball, soccer, rugby, etc. or individual sports such as jai a'lai, tennis, golf, etc. Once the sporting event has been chosen, possible outcomes must be determined and outcome numbers assigned. In the case where the sporting event is a race, outcome numbers can be assigned to each of the entrants in the race. In horse racing, for instance, where the entrants are generally assigned numbers starting with one up to the number of race entrants, the outcome numbers could simply be the numbers previously assigned to the race entrants. In the case of team sports, outcome numbers could be assigned to each team or to possible results such as scores, performances of different players or any of a variety of other statistics which are calculated for those sports. Although the assigning of outcome numbers is shown as occurring after ticket sales have stopped, it may be advantageous to do so before sales have even begun. In that way the ticket purchaser will know immediately after buying a ticket what sporting event outcome will lead to that player winning. If outcome numbers are determined before sales of tickets is terminated, it is particularly important that the numbers be randomly generated so that a player cannot pick numbers which have higher than average chances of becoming winning numbers.

Control next passes to block 20 where the sporting event is run. It is not necessary that the entity running the lottery also be the same entity which runs the sporting event. However, while the event is run, there should be some mechanism for observing the results not only by the entity running the lottery, but also by players who have purchased lottery tickets. It is advantageous for lottery players to be able to observe the event, because it adds excitement and suspense to the lottery where, for instance, the players are watching a horse race and can observe whether their tickets have numbers which correspond to the winners of the race. The entity running the lottery then determines the winning numbers as shown in block 22. The winning numbers may then be printed in newspapers or displayed at lottery locations so that those purchasers who did not view the sporting event can determine whether they have won.

Control then passes to block 24 where winning ticket holders are paid. Such payment can be done automatically by electronic means or the ticket holder may present a winning ticket for payment. The amount of payment will be dependent on the particular design of the lottery and how many and in what order a player's random numbers match the winning numbers. For instance, a lottery having single, multi-digit random numbers might be won by only one player having an exact match to a winning number. In other cases, players will win by matching any one of a plurality of winning numbers. In the case where each player has a group of random numbers and there are a group of winning numbers, payment may be made according to how many of the player's numbers match the winning numbers or in what order or pattern the sets of numbers match. Generally, a player with more matches will be paid more than one with fewer matches, since the odds against having more matches are greater than the odds against having fewer matches. The total paid to all players should, on average, be some fraction of the receipts from ticket sales.

Figure 2:
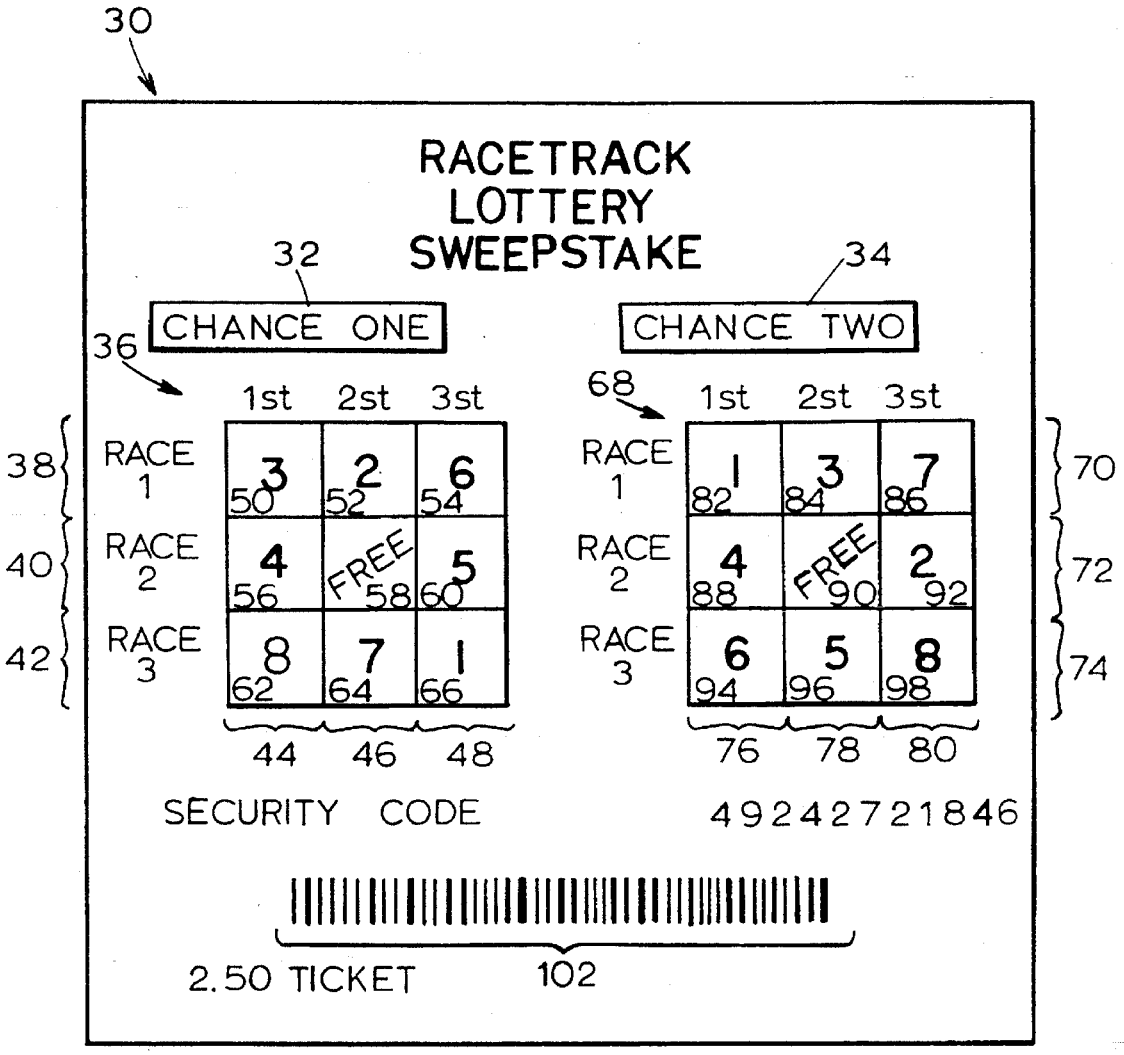
FIG. 2 is a plan view of a lottery ticket used in the method of running a lottery game of the present invention.

Referring now to FIG. 2, a ticket 30 is shown for use with an embodiment of the present invention where the sporting event is a series of three races. Ticket 30 provides two separate groups of random numbers, chance one 32 and chance two 34. Each of chance 32 and 34 represents separate groups of random numbers which have been independently generated. Although two chances are shown on the lottery ticket 30, it is possible to have any number of chances including 1, 2 or 4.

Chance 34 has random numbers printed in a grid indicated generally at 36, having rows 38, 40 and 42 and columns 44, 46 and 48. Each row therefore has three spaces and each column also has three spaces, so that grid 36 has nine spaces 50, 52, 54, 56, 58, 60, 62, 64 and 66. Randomly generated numbers are placed in each of the spaces in the grid 36 with the exception of the center space 58 where a "free" space is designated. The "free" space is essentially a winning space for the player and can be situated in any space or spaces on a grid. Row 38 represents the possible results of a first race, row 40 the possible results of a second race and row 42 the possible results of a third race. Preferably each of race 1, race 2 and race 3 would be races run on the same day at a particular race track. However, it is possible to hold each of the three races on separate days or at separate race tracks.

Column 44 represents the first place finishers in each of the three races, column 46 the second place finishers and column 48 the third place finishers. Although first, second and third places are preferable, it is possible to select any order of finishers for columns 44, 46 and 48.

Chance two 34 has a grid 68, rows 70, 72 and 74 similar to rows 38, 40 and 42 and columns 76, 78 and 80 similar to columns 44, 46 and 48. Like grid 36, grid 68 has nine spaces 82, 84, 86, 88, 90, 92, 94, 96 and 98. The rows and columns of grid 68 represent the same races and orders of finish as the respective rows and columns of grid 36, but it is possible to have grids with different races or orders of finish on one ticket.

The ticket 30 also has a security code 100 and bar code 102. Security code 100 and bar code 102 are used to verify the authenticity of the ticket. The bar code can be used with a bar code reader of the type commonly found in devices used with lotteries or parimutuel betting to automatically determine whether a ticket is a winning ticket.

Once race 1, race 2 and race 3 have been run, the winning numbers can be determined and put into a three-by-three grid like grids 36 and 68. The grid of winning numbers is then compared with grid 36 or 68, and a pattern is formed by determining which numbers in grids 36 and 68 match the numbers in the winning grid. For instance, if a sporting event consisted of three horse races and in the first race the order of finish was horse 3, horse 2 and horse 6, the first row of the winning grid would be "3 2 6." If in the second race the order of finish was horse 3, horse 8 and horse 5, the second row of the winning grid would then be "3 8 5." If the order of finish in the third race was horse 6, horse 2 and horse 1, the third row of the winning grid would be "6 2 1." When comparing the winning grid with grid 36, there would be matches in box 50, box 52, box 54, box 60 and box 66. In addition, since box 58 is a free space, there would be a match in that box as well. Therefore, in the pattern formed by comparing grid 36 to the winning grid, all of the first row (boxes 50, 52, 54) would be a complete row and column 48 (boxes 54, 60 and 66) would be a complete column. In addition, the diagonal formed by box 50, 58 and 66 would also be complete. For chance 32, therefore, the total number of complete rows, columns and diagonals would be three. The payment to the player would then be based on having three winning lines. It is possible for a grid to have anywhere from zero winning lines to a total of eight winning lines (three rows plus three columns plus two diagonals). Since the odds increase the more winning lines a chance has, the payout increases for each complete line.

Grid 68 only has one match, box 94, and a free space in box 90. Therefore, the pattern formed by comparing the winning grid to grid 68 yields no complete rows, columns or diagonals and would have a commensurate payout, probably zero.

While the three-by-three grid or tic-tac-toe board is preferred, a variety of other grids or shapes yielding different types of winning patterns are possible. In addition, although only single-digit numerals are shown in grid 36 and grid 68, it is possible to place higher numbers in each of the boxes, should, for instance, a race have more than 10 entrants. It is also possible to base payments on patterns other than complete rows, columns or diagonals, such as four corners or sets of two-square couplets adjacent each other. The three-by-three or other size grid can also be used with sporting events other than races.

The three-by-three grid with payouts based on complete rows or columns has several advantages. If, after a race 1 has been run, a player has a complete row, there is additional incentive to continue watching the races. A player that has only a partially complete first row or even a first row with no matches can still win and therefore will also want to continue watching the race or other sporting event.

Any of the automated steps in the above description can be easily implemented on conventional devices currently used for lotteries. The computers running those devices need only be reprogrammed to accomodate the particular format of cards, grids, number types, etc. to be used, and can be accomplished by those skilled in the art.

The foregoing detailed description has been provided for clearness of understanding and no unnecessary limitations should be understood therefrom, as modifications will be obvious to those skilled in the art.

I claim:

1. A method of playing a lottery game comprising the steps of:

a player paying a fee for a chance at winning the lottery;

generating, when the fee is paid, random numbers which are not selected by the player and assigning the random numbers to the player;

selecting a sporting event having a set of possible outcomes and assigning outcome numbers to the possible outcomes of the sporting event;

observing the sporting event and determining a set of winning numbers from the outcome numbers based on the outcome of the sporting event;

comparing the set of winning numbers to the random numbers assigned to the player; and paying the player a sum based on the similarity of the random numbers to the set of winning numbers.

2. The method of playing a lottery game of claim 1 wherein:

the sporting event comprises a race having a plurality of entrants; and the winning numbers are determined in accordance with the places in which entrants finish the race.

3. The method of playing a lottery game of claim 2 wherein:

the sporting event comprises a plurality of races with a plurality of entrants in each race; and the winning numbers are determined in accordance with the places in which the entrants in each race finish those races.

4. The method of playing the lottery game of claim 3 wherein:

the sporting event comprises three races and each race has a first place, a second place and a third place finisher;

there are a group of random numbers and the group of random numbers are placed in a first grid having a first row, a second row, a third row, a first column, a second column and a third column;

the winning numbers are determined by the first place, second place and third place finishers in each of the three races;

the winning numbers are placed in a second grid having a first row, a second row, a third row, a first column, a second column and a third column; and the player is paid in accordance with a pattern formed by the numbers in the first grid which match the numbers in corresponding rows and columns of the second grid.

5. The method of playing the lottery game of claim 4 wherein:

the pattern may have complete rows and complete columns; and the player is paid in accordance with the number of complete rows and complete columns in the pattern.

6. The method of playing the lottery game of claim 5 wherein:

the pattern may have complete diagonals; and the player is paid in accordance with the number of complete rows, columns and diagonals in the pattern.

7. The method of playing the lottery game of claim 4 wherein the first grid has a free space.

8. The method of playing the lottery game of claim 4 wherein:

the winning numbers in the first row of the second grid are determined by the first place, second place and third place finishers in the first race;

the winning numbers in the second row of the second grid are determined by the first place, second place and third place finishers of the second race; and the winning numbers in the third row of the second grid are determined by the first place, second place and third place finishers of the second race.

9. The method of playing the lottery game of claim 1 wherein the random numbers are printed on a card.

10. The method of playing the lottery game of claim 9 wherein the card has two groups of random numbers and each group is printed in a grid having three rows and three columns.

11. The method of playing a lottery game of claim 10 wherein the card has four groups of random numbers.

12. The method of playing a lottery game of claim 1 wherein there are a plurality of players and each player is assigned random numbers different from any other player's random numbers.

13. A method of playing a lottery game comprising the steps of:

a player paying a fee for a chance at winning the lottery;

generating, when the fee is paid, a group of random numbers which are not selected by the player and assigning the group of random numbers to the player;

selecting a sporting event having a set of possible outcomes and assigning outcome numbers to the possible outcomes of the sporting event;

observing the sporting event and determining a set of winning numbers from the outcome numbers based on the outcome of the sporting event;

comparing the set of winning numbers to the group of random numbers assigned to the player; and paying the player a sum based on the similarity of the group of random numbers to the set of winning numbers;

wherein the sporting event comprises a plurality of races with a plurality of entrants in each race;

the winning numbers are determined in accordance with the places in which the entrants in each race finish those races; and the group of random numbers is printed on a card.

14. The method of playing the lottery game of claim 13 wherein the card has two groups of random numbers and each group is printed on a grid having three rows and three columns.

15. The method of playing a lottery game of claim 14 wherein the card has four groups of random numbers.

16. The method of playing a lottery game of claim 15 wherein there are a plurality of players and each player has an assigned group of random numbers different from any other player's assigned group of random numbers.

17. A method of playing a lottery game comprising the steps of:

a player paying a fee for a chance at winning the lottery;

generating, when the fee is paid, random numbers which are not selected by the player and assigning the random numbers to the player;

selecting a sporting event having a set of possible outcomes and assigning outcome numbers to the possible outcomes of the sporting event;

observing the sporting event and determining a set of winning numbers from the outcome numbers based on the outcome of the sporting event;

comparing the set of winning numbers to the random numbers assigned to the player; and paying the player a sum based on the similarity of the random numbers to the set of winning numbers;

wherein the sporting event comprises three races and each race has a first place, a second place and a third place finisher;

the group of random numbers are placed in a grid having a first row, a second row, a third row, a first column, a second column and a third column;

the winning numbers are placed in a second grid having a first row, a second row, a third row, a first column, a second column and a third column;

the player is paid in accordance with a pattern formed by the numbers in the first grid which match the numbers in corresponding rows and columns of the second grid;

the pattern may have complete rows, complete columns and complete diagonals;

the player is paid in accordance with the number of complete rows, columns and diagonals in the pattern;

the winning numbers in the first row of the second grid are determined by the first place, second place and third place finishers in the first race;

the winning numbers in the second row of the second grid are determined by the first place, second place and third place finishers of the second race; and the winning numbers in the third row of the second grid are determined by the first place, second place and third place finishers of the second race.

18. The method of playing the lottery game of claim 17 wherein the random numbers are printed on a card.

19. The method of playing the lottery game of claim 18 wherein the card has two groups of random numbers and each group is printed in a grid having three rows and three columns.

20. The method of playing a lottery game of claim 19 wherein the card has four groups of random numbers.

* * * * *